US008618433B2

(12) United States Patent
Heusel

(10) Patent No.: US 8,618,433 B2
(45) Date of Patent: Dec. 31, 2013

(54) WORKPIECE PART DISCHARGE SYSTEM

(75) Inventor: Joerg Heusel, Stuttgart (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 1312 days.

(21) Appl. No.: 12/164,386

(22) Filed: Jun. 30, 2008

(65) Prior Publication Data

US 2009/0010731 A1 Jan. 8, 2009

(30) Foreign Application Priority Data

Jun. 30, 2007 (EP) ..... 07012867

(51) Int. Cl.
*B23H 7/00* (2006.01)

(52) U.S. Cl.
USPC ..... 219/69.11; 219/69.12; 219/69.13; 219/69.14; 219/69.15; 219/69.16; 72/190; 72/195; 83/13; 83/23; 83/24; 83/100; 83/684; 414/790.8; 414/794.2

(58) Field of Classification Search
CPC .... A47J 37/1219; A47J 37/12; B21D 45/003; B21D 28/36; B26D 7/06
USPC ..... 219/69.11–69.17; 72/190, 195; 83/13, 83/23, 24, 27, 100, 111, 359, 360, 409, 83/684–685; 99/537; 414/790.8, 794.2
See application file for complete search history.

(56) References Cited

U.S. PATENT DOCUMENTS 2,796,128 A * 6/1957 Danek ..... 83/24
2,824,610 A * 2/1958 Schubert et al. ..... 19/161.1
3,375,744 A * 4/1968 Schieven ..... 83/23
3,772,948 A * 11/1973 Burton ..... 83/23
4,565,915 A * 1/1986 Girardin ..... 219/69.12
4,691,089 A * 9/1987 Balleys ..... 219/69.12
4,787,282 A * 11/1988 Okachi et al. ..... 83/25
4,960,971 A * 10/1990 Kawanabe ..... 219/69.12
5,088,363 A * 2/1992 Jones et al. ..... 83/35
5,243,165 A * 9/1993 Hosaka ..... 219/69.12
5,626,066 A * 5/1997 Lallement ..... 83/451
5,687,205 A * 11/1997 Matsumoto et al. ..... 376/260
6,103,987 A * 8/2000 Nordquist ..... 219/69.12
6,246,024 B1 * 6/2001 Hosaka ..... 219/69.12

(Continued)

FOREIGN PATENT DOCUMENTS

DE 3736868 A1 * 5/1989
JP 61295967 12/1986

(Continued)

OTHER PUBLICATIONS

European Search Report and Communication from corresponding European Application No. 07 01 2867.3 mailed Nov. 26, 2007, 4 pages.

*Primary Examiner* — Henry Yuen
*Assistant Examiner* — Brett Spurlock
(74) *Attorney, Agent, or Firm* — Fish & Richardson P.C.

(57) ABSTRACT

A machine tool for separative machining of preferably plate-like workpieces, for example, metal sheets, has a workpiece support and a discharge device on the workpiece support. The discharge device discharges workpiece parts produced as products of the separative machining. The discharge device includes two opening sections are adjustable relative to one another in the horizontal Y direction to form a through-opening for discharge of workpiece parts. The opening sections are adjustable into different positions relative to one another in the horizontal Y direction, to form through-openings of different widths for discharge of workpiece parts.

17 Claims, 7 Drawing Sheets

(56) References Cited

U.S. PATENT DOCUMENTS

| | | | | |
|---|---|---|---|---|
| 6,339,203 | B1 * | 1/2002 | Nakamura et al. | 219/69.2 |
| 6,486,429 | B1 * | 11/2002 | Wehrli et al. | 219/69.11 |
| 6,602,561 | B1 * | 8/2003 | Moro et al. | 427/580 |
| 6,716,146 | B2 * | 4/2004 | Kato | 483/58 |
| 6,739,244 | B1 * | 5/2004 | Carbaugh | 101/3.1 |
| 6,979,795 | B1 * | 12/2005 | Kaneko et al. | 219/69.16 |
| 6,998,561 | B2 * | 2/2006 | Kato et al. | 219/69.12 |
| 6,998,562 | B2 * | 2/2006 | Arakawa et al. | 219/69.12 |
| 7,002,093 | B2 * | 2/2006 | Arakawa et al. | 219/69.12 |
| 7,009,133 | B2 * | 3/2006 | Takayama et al. | 219/69.12 |
| 7,019,246 | B2 * | 3/2006 | Kurihara et al. | 219/69.12 |
| 7,038,158 | B2 * | 5/2006 | Goto et al. | 219/69.12 |
| 7,211,762 | B2 * | 5/2007 | Kinoshita | 219/69.12 |
| 7,259,347 | B2 * | 8/2007 | Sasaki et al. | 219/69.13 |
| 7,262,381 | B2 * | 8/2007 | Hiraga et al. | 219/69.12 |
| 7,301,116 | B2 * | 11/2007 | Chen et al. | 219/69.16 |
| 7,367,930 | B2 * | 5/2008 | Yamazaki et al. | 483/16 |
| 7,371,989 | B2 * | 5/2008 | Miyajima et al. | 219/69.12 |
| 2004/0217089 | A1 * | 11/2004 | Kita et al. | 219/69.12 |
| 2005/0145603 | A1 * | 7/2005 | Goto et al. | 219/69.12 |
| 2005/0269296 | A1 * | 12/2005 | Arakawa et al. | 219/69.12 |
| 2005/0284846 | A1 * | 12/2005 | Nakashima et al. | 219/69.12 |
| 2006/0065638 | A1 * | 3/2006 | Sasaki et al. | 219/69.13 |
| 2006/0091113 | A1 * | 5/2006 | Hiraga et al. | 219/69.12 |
| 2006/0102596 | A1 * | 5/2006 | Kinoshita et al. | 219/69.12 |
| 2007/0011861 | A1 * | 1/2007 | Kosuge et al. | 29/559 |
| 2007/0102402 | A1 * | 5/2007 | Miyake et al. | 219/69.15 |
| 2007/0187367 | A1 * | 8/2007 | Kita et al. | 219/69.11 |
| 2007/0266836 | A1 * | 11/2007 | Marks | 83/684 |
| 2008/0058187 | A1 * | 3/2008 | Yamazaki et al. | 483/16 |
| 2010/0116107 | A1 * | 5/2010 | Spillner et al. | 83/13 |
| 2011/0265624 | A1 * | 11/2011 | Pasek et al. | 83/409 |

FOREIGN PATENT DOCUMENTS

| | | | |
|---|---|---|---|
| JP | 05-192725 | | 8/1993 |
| JP | 07-214359 | | 8/1995 |
| JP | 10216860 | A * | 8/1998 |
| JP | 2003117762 | | 4/2003 |
| JP | 2003245838 | | 9/2003 |

* cited by examiner

WORKPIECE PART DISCHARGE SYSTEM

CROSS REFERENCE TO RELATED APPLICATION

This application claims priority under 35 U.S.C. §119(a) to European Patent Application No. 07 012 867.3, filed on Jun. 30, 2007, the entire contents of which are hereby incorporated by reference.

TECHNICAL FIELD

The invention relates to a machine tool for separative machining of workpieces, for example, metal sheets.

BACKGROUND

A generic prior art machine tool is known, in which a first opening boundary is arranged in a fixed position in the horizontal direction and a second opening boundary moves in the horizontal direction relative to the first opening boundary and can be positioned in a fixed position. Movement of the second opening boundary to the fixed position causes a through-opening to be formed between the opening boundaries, through which a workpiece part can be discharged downwards. The displacement path of the second opening boundary is here dimensioned so that workpiece parts up to a maximum dimension in the horizontal direction of typically 500 mm can be discharged.

SUMMARY

In one general aspect, a machine tool for separative machining of workpieces includes a workpiece support; and a discharge device provided on the workpiece support for discharging workpiece parts produced as products of the separative machining. The discharge device includes two opening sections that are adjustable relative to one another in a horizontal Y direction that lies in an X-Y plane with mutual displacement to form a through-opening for discharge of workpiece parts along a vertical direction Z that is perpendicular to the surface of the X-Y plane. The opening sections are adjustable relative to one another in the horizontal Y direction to form through-openings of different widths for discharge of workpiece parts. At least one opening section includes a support that is mounted to widen the through-opening by being pivoted downwardly about a pivot axle that lies in the X-Y plane.

Implementations can include one or more of the following features. For example, the machine tool can include a control unit for controlling the position of the opening sections produced during separative machining of the workpiece as a function of a maximum dimension in the horizontal Y direction of the workpiece part. The machine tool can include a movement unit that is configured to continuously move at least one of the opening sections in the horizontal Y direction. The movement unit can include a spindle drive. The machine tool can include a measuring device that determines the distance traveled by the opening sections in the horizontal Y direction.

The pivot axle can extend at a right angle to the horizontal Y direction.

At least one support can be rotatably mounted to a supporting table that is displaceable in the horizontal Y direction. The supports can be lowerable, under acceleration, with a linear movement in the Z direction. The supports can be lowerable with a linear movement a distance of less than or equal to about 10 mm.

At least one opening section can include a supporting table that is displaceable in the horizontal Y direction. At least one end of the supporting table nearest the through opening can be lowerable under acceleration in the direction of gravity.

The opening sections can be movable relative to one another in the horizontal Y direction into a closed position in which the opening sections close an opening in the workpiece support. The supports in a downwardly pivoted state can have upper surfaces that lie at least partially adjacent to one another when the opening sections are in the closed position.

One of the two opening sections can be in a fixed position in the horizontal Y direction. The machine tool can include a fixing device that fixes the workpiece part in position at the fixed-position opening section during relative movement of the opening sections in the horizontal Y direction.

The machine tool can include a rigid chute arranged in the through-opening beneath the opening sections and configured to discharge the workpiece part.

In another general aspect, workpiece parts produced on a machine tool as products of the separative machining are discharged using a discharge device. The discharge device includes two opening sections that are adjusted relative to one another in a horizontal Y direction to form a through-opening for discharge of workpiece parts. The opening sections are moved into different positions relative to one another in the horizontal Y direction to form through-openings of different width for discharge of workpiece parts and the through-openings are widened by pivoting downwardly about a pivot axle that lies in the X-Y plane a support of the opening section.

Implementations can include one or more of the following features. For example, the position of the opening sections can be controlled as a function of a maximum dimension in the horizontal Y direction of the workpiece part. The opening sections can be moved by continuously displacing at least one of the opening sections with continuous displacement control in the horizontal Y direction.

In another general aspect, a machine tool for separative machining of workpieces includes a workpiece support; and a discharge device provided on the workpiece support for discharging workpiece parts produced as products of the separative machining. The discharge device includes two opening sections that are adjustable relative to one another in a horizontal Y direction that lies in an X-Y plane to form a through-opening for discharge of workpiece parts along a vertical direction Z that is perpendicular to the surface of the X-Y plane. The opening sections are adjustable relative to one another in the horizontal Y direction to form through-openings of different widths for discharge of workpiece parts. At least one opening section includes a supporting table that is displaceable in the horizontal Y direction.

In another general aspect, a machine tool for separative machining of workpieces includes a workpiece support, a discharge device on the workpiece support and configured for discharging workpiece parts produced as products of the separative machining, and a fixing device that fixes the workpiece part in position at the fixed-position opening section during relative movement of the opening sections in the horizontal Y direction. The discharge device includes two opening sections that are adjustable relative to one another in a horizontal Y direction that lies in an X-Y plane to form a through-opening for discharge of workpiece parts along a vertical Z direction that is perpendicular to the surface of the X-Y plane, the opening sections are adjustable relative to one another in the horizontal Y direction, to form through-openings of different widths for discharge of workpiece parts.

Implementations can include one or more of the following features. For example, fixing device can include a punch apparatus having a resilient element and a punch.

A machine tool and a method for discharging workpiece parts are designed to more rapidly discharge the workpiece parts and hence the idle time of the machine tool during discharge can be reduced.

The opening sections are adjustable into different positions relative to one another with mutual displacement in the horizontal direction, to form through-openings of different widths for discharge of workpiece parts.

At least two different positions are provided, in which the opening boundaries can be positioned during the relative movement in the horizontal direction and which, by virtue of the relative movement, each form a through-opening, through which a workpiece part can be discharged. For that purpose, the opening sections can be positioned, for example, at a plurality of different fixed positions each spaced from the other.

In some embodiments, the machine tool has a control unit for controlling the position of the opening sections as a function of a maximum dimension in the horizontal direction of the workpiece part produced during separative machining of the workpiece. In this way, it is possible to select the position in which discharge through the through-opening is only just possible for a workpiece part to be discharged at any one time, thus ensuring that the opening sections do not have to be moved further in the horizontal direction than is necessary to discharge the workpiece part produced at any one time. The path of movement of the opening sections for discharge of workpiece parts is thereby minimized or reduced, with the result that the speed during discharge is increased and hence the idle time of the machine tool during discharge can be reduced. Information about the maximum dimension of the workpiece part to be discharged each time is already available in the control unit of the machine tool, since this is needed for controlling the separative machining of the workpiece.

In some embodiments, the machine tool includes a movement unit for displacement-controlled, continuous movement of at least one of the opening sections. In that case, the different positions are continuously selectable over the travel of the opening section, thus enabling the position to be exactly matched to the dimension of the workpiece part in the horizontal direction.

In some implementations, the movement unit includes a spindle drive for continuous movement of at least one of the opening sections in the direction of the opening movement. Such a spindle drive typically includes a gear spindle, which is driven via an electric motor and allows a linear movement of the opening sections that is both rapid and precise.

In some implementations, the machine tool also includes a measuring device for determining the distance covered by the opening sections in the horizontal direction. The path of movement covered can thereby be monitored and, if need be, corrected.

In other implementations, at least one opening section includes a support, which is mounted so as to pivot downwardly about a pivot axle running preferably at right angles to the direction of the opening movement. Normally, during movement of the opening sections, the workpiece part lies on the upper surface of the support until the particular position for discharge of the workpiece is reached. The support is then pivoted and the workpiece part can be brought to a removal position below the support or the opening section. Alternatively, a superimposed movement is possible, in which the support is already being pivoted during the movement of the opening sections. By providing pivotable supports at the opening sections, the path of movement of the opening sections can be reduced, since the through-opening can be widened by pivoting the supports.

In a preferred refinement, at least one opening section includes a supporting table displaceable in the horizontal direction, on which the support is rotatably mounted. The opening section can here be adjusted to a position in which the workpiece part lies only on the support and not on the supporting table. The support is then pivoted, and the workpiece part can be removed downwards through the through-opening. If supports are provided at both opening sections, by synchronous pivoting of the supports the workpiece part can be discharged under the effect of gravity in the direction of gravity through the through-opening, without the workpiece part at the same time performing a rotary movement. If the supports in the supporting regions where the workpiece part is supported on their upper surfaces are moved downwards during pivoting with an acceleration that is greater than that of the workpiece part, then the workpiece part lifts away from the supports and can free fall to a removal position situated below the supports.

In some implementations, the supports are lowerable, under acceleration, with a linear movement in the direction of gravity, the linear movement preferably being effected over a distance of at most 10 mm, in particular of at most 8 mm. In that case, the lowering movement is preferably effected with an acceleration greater than the acceleration due to gravity, so that the workpiece part lifts away from the supports.

In other implementations, at least one opening section includes a horizontally displaceable supporting table, which preferably at least at one end nearest the through-opening is lowerable, under acceleration, with a linear movement in the direction of gravity, the linear movement preferably being effected over a distance of at most 10 mm, in particular of at most 8 mm. In particular, when the opening sections do not have pivotable supports, it is advantageous to implement a linear lowering movement at the supporting table itself. The linear movement can here be effected by a parallel displacement of the supporting table in the direction of gravity or the supporting table can preferably be rotatably mounted at the end remote from the through-opening, so that in the case of a supporting table that has an adequate length in the horizontal direction (normally more than 1000 mm, preferably more than 1500 mm), at the end nearest the through-opening a virtually linear movement in the direction of gravity is achieved over the comparatively small distance to be covered in the vertical direction. The supporting table may also be non-rotatably mounted at the end remote from the through-opening and consist of a flexible material. If, to generate the lowering movement, the supporting table is in that case supported only at its end remote from the through-opening, with a suitable choice of the resilient properties of the material and the length and the width of the supporting table, a virtually linear lowering movement at the end nearest the through-opening is achieved. It will be understood that here in each case the mounting of the support table at the end nearest the through-opening can be effected by an axle controllable in the vertical direction.

In other implementations, the opening sections are movable relative to one another in the horizontal direction into a closed position, in which the opening sections completely or nearly completely close an opening in the workpiece support and in which preferably the supports in the downwardly pivoted state lie adjacent to one another at least partially with their upper surfaces. The closed position can be assumed when the supports are to be protected or an opening in the workpiece support is to be completely closed. This may be the case, for example, when the machine tool has more than one machining station, that is, when, for example, in addition to a laser cutting station a punching station is provided. If the opening sections are mounted at the laser cutting station, and if the laser processing is complete, the closed position is assumed before the punching station commences processing of the workpiece part. The two opening sections can also assume a closed position, in which an opening in the workpiece support is completely closed, independently of the provision according to the invention of different-width through-openings.

In another embodiment, one of the two opening sections is arranged in a fixed position in the horizontal direction. This fixed-position opening section can be located at a machining position of the machine tool and serves there to support the workpiece during machining, for example, when cutting a workpiece part free from a workpiece at a laser cutting station, in order to prevent the workpiece part sagging as it is cut free. Workpiece separation in this case can be effected either before or after setting the opening sections to the position provided in each case for discharge.

In another embodiment, the machine tool includes a fixing device for fixing the workpiece part in position at the fixed-position opening section during relative movement of the opening sections in the horizontal direction. This can be needed where appropriate when the workpiece part is displaced too far in the horizontal direction as it is slid along the upper face of the movable opening section, or when the workpiece part is supported on the upper face of the opening sections using guide rollers. In particular, the fixing device can be formed by the punch apparatus, at which the fixed-position opening section is used as a die block for a punch of the punch apparatus. The punch apparatus can be include a spring, for example, of Eladur™, arranged on sides of the punch, and the spring fixes the workpiece part in position when the punch remains inserted into the die block during the movement in the horizontal direction.

In another embodiment, a rigid chute for discharging the workpiece part is arranged in the through-opening beneath the opening sections. The workpiece part falls through the through-opening onto the rigid chute and slides along this in order to be removed from the machine tool in this way.

The invention is also implemented in a method of the kind described initially, in which the opening sections are adjusted relative to one another in the horizontal direction with mutual displacement to form a through-opening for discharge of workpiece parts. Advantageous variants of this method are specified in the claims. Reference can be made to the above description relating to the machine tool in respect of the advantages connected with these variants.

Further advantages of the invention are apparent from the description and the drawing. The above-mentioned features and also those listed hereafter can be used alone or severally in any combination. The embodiments described and shown are not to be understood as an exclusive enumeration, but are merely of an exemplary nature for the description of the invention.

DETAILED DESCRIPTION

Figure 1:
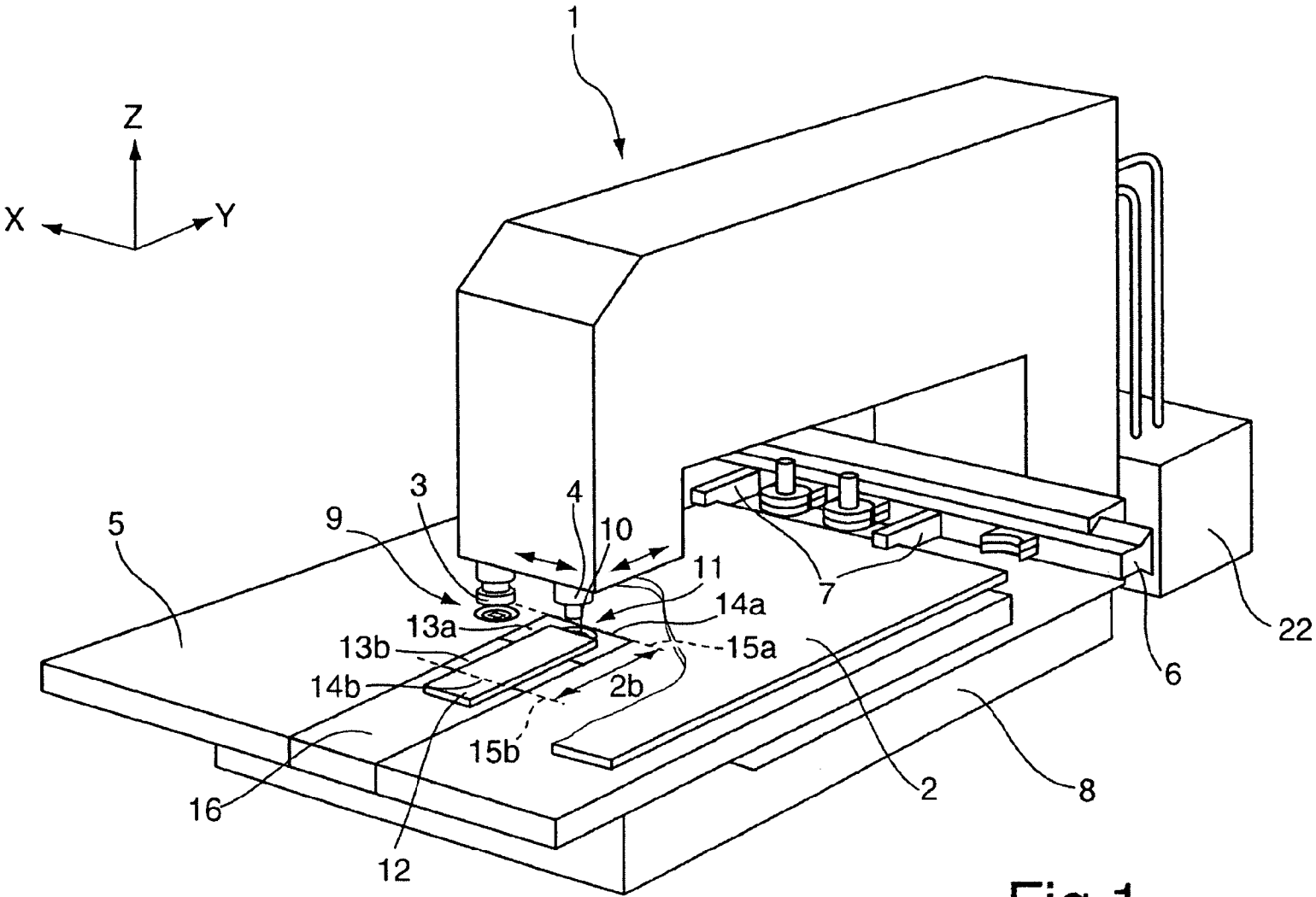
FIG. 1 is a perspective view of a machine tool.

FIG. 1 shows a machine tool 1 in the form of laser punch press, which includes a conventional punch apparatus 3 and a laser machining head 4 that are used as tools for machining a workpiece 2 such as a metal sheet. The workpiece 2 to be machined is supported during machining of the workpiece on a workpiece support 5 in the form of a machining table. By means of a conventional holding device 6, which includes clamps 7 for holding the workpiece 2, the workpiece 2 can be displaced with respect to the punch 3 and the laser machining head 4 in the X direction of the sheet plane (that is, the X-Y plane of an XYZ co-ordinate system). The workpiece 2 can be moved in the Y direction of the sheet plane by displacing the workpiece support 5, together with the holding device 6, by means of a conventional guide (not shown) relative to a base 8, on which the workpiece support 5 is supported.

The workpiece 2 can thus be displaced in the X and Y directions with respect to the punch apparatus 3 and the laser machining head 4, so that the region of the workpiece 2 that one plans to process or machine can be brought into a machining region 9 of the punch apparatus 3, which is fixed in position, or into a machining region 11 of the laser machining head 4, which is defined by a substantially circular suction opening 10 in the workpiece support 5. The subregion of the workpiece support 5 in the X direction, on which the machining regions 9, 11 are formed, is stationary, and is not displaced in the Y direction relative to the base 8. The punch apparatus 3 can be movable in a Z direction and the laser machining head 4 can be movable in the X and Y directions within the area of the suction opening 10.

Once a region of the workpiece 2 has been brought into the machining region 11 of the laser machining head 4, as described above, the laser machining head 4 is activated to cut, for example, a rectangular workpiece part 12 completely free from the workpiece 2. After being cut free, the workpiece part 12 rests in the plane of the sheet (which is parallel with the X-Y plane) on a supporting table 16 and on two supports 13*a*, 13*b* adjoined to one another and positioned parallel with the plane of the sheet, the supports 13*a*, 13*b* being in the form of flaps. The first support 13*a* is arranged directly below the laser machining head 4 and has the suction opening 10 defining the machining region 11.

To bring the workpiece part 12 out of the plane of the sheet into a removal position (not shown in FIG. 1) located beneath the plane of the sheet and beneath the workpiece, the supports 13*a*, 13*b* may be pivoted at opposite sides 14*a*, 14*b* around two parallel pivot axles 15*a*, 15*b*. The pivot axles 15*a*, 15*b* are arranged at a distance apart that corresponds to twice the width (2*b*) of each of the two supports 13*a*, 13*b* in the Y direction. When the supports 13*a*, 13*b* are positioned as shown in FIG. 1, the workpiece part 12, the dimension of which in the Y direction is larger than the width 2*b*, cannot be brought into the removal position without being rotated about its own axis (which extends along the Z direction), which would result in a slow discharge of the workpiece part 12.

In order to be able to discharge the workpiece part 12 without producing a rotary movement about the Z direction, the second support 13*b* is secured to the supporting table 16 and can be displaced jointly with the supporting table 16 in the Y direction, i.e., horizontally, in the plane of the sheet. The distance between the two pivot axles 15*a*, 15*b* is thereby enlarged in the Y direction and between the two supports 13*a*, 13*b* a through-opening (not shown in FIG. 1) forms in the workpiece support 5. The supporting table 16 is displaced until the workpiece part 12 rests only at its opposite ends on the upper surfaces of the two supports 13*a*, 13*b* and no longer lies on the supporting table 16.

Figure 2A:
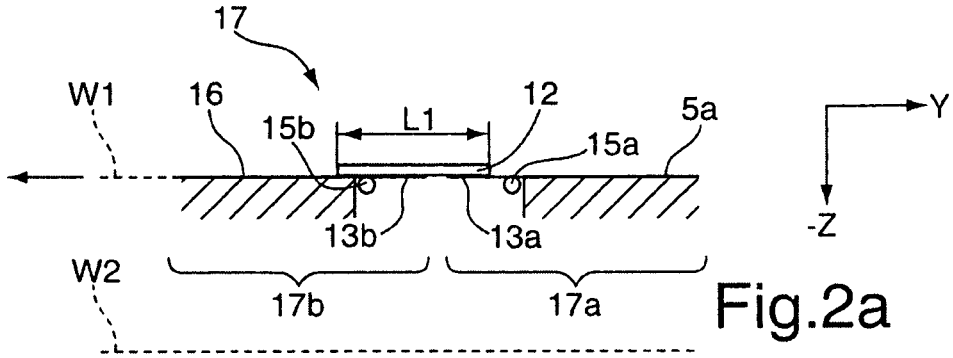
FIGS. 2*a*-2*d* are cross-sectional views of a workpiece part and a workpiece support showing a process for discharging the workpiece part through a through-opening.

The process of discharging the workpiece part 12 out of the position W1 shown in FIG. 1 in which the workpiece part 12 is located in the plane of the workpiece support 5, into a removal position W2 located beneath the position W1, is explained in detail with reference to FIGS. 2*a-d*. In FIG. 2*a*, the workpiece part 12 is supported both on the upper surface of the first support 13*a*, which together with a stationary part of the workpiece support 5*a* form a first opening section 17*a*, and on the upper surface of the second support 13*b* and on the supporting table 16, which together form a second opening section 17*b*. The two opening sections 17*a*, 17*b* form two parts of a discharge device 17 for discharging the workpiece part 12.

Figure 2B:
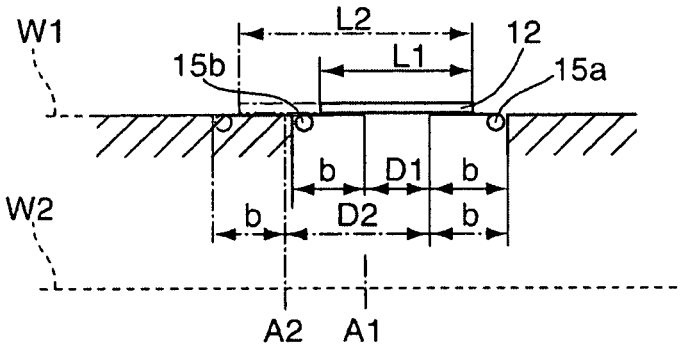

The opening sections 17*a*, 17*b* in FIG. 2*a* are located in a position in which the two supports 13*a*, 13*b* are near or close to each other. The workpiece part 12 lies on the supporting table 16 and without being moved along the plane of the sheet cannot be discharged vertically (along the Z direction) downwards. To discharge the workpiece part 12, the second opening section 17*b* is therefore moved horizontally along the arrow shown in FIG. 2*a* by moving the supporting table 16 in the Y direction until the second opening section 17*b* has reached a position at which the edge of the second support 13*b* is at position A1, and in this position, the workpiece part 12 no longer lies on the supporting table 16, as shown in FIG. 2*b*. After movement in the Y direction, a through-opening D1 forms between the two supports 13*a*, 13*b*, through which the workpiece part 12 can be discharged downwards, by pivoting the supports 13*a*, 13*b* downwards about the respective pivot axles 15*a*, 15*b* and thereby enlarging the through-opening D1 substantially by twice the amount 2*b* of the width of the supports 13*a*, 13*b*.

The position A1 of the second opening section 17*b* depends both on the position of the workpiece part 12 relative to the supports 13*a*, 13*b* and on the maximum dimension (that is, a length) L1 of the workpiece part 12 in the horizontal Y direction. Since the position of the end of the workpiece part 12 that lies on the stationary opening section 17*a* corresponds, after the cutting has finished, to the position of the machining region 10, the discharge position A1 is determined substantially by the length L1 of the workpiece part 12 in the horizontal Y direction and is selected so that the workpiece part 12 can only just be discharged through the through-opening D1 widened by twice the amount 2*b* of the width of the supports 13*a*, 13*b*.

In FIG. 2*b*, a further position A2 of the second opening section 17*b* is shown by a dot-dash line, in which a further through-opening D2 is formed, the width of which is larger than the through-opening D1. A workpiece part 12 having a larger maximum dimension (that is, a length) L2 can be discharged through the through-opening D2 widened by twice the amount 2*b* of the width of the supports 13*a*, 13*b*. The travel of the opening sections 17*a*, 17*b* is calculated as a function of the lengths L1 and L2 of the workpiece part 12 by the numerical control (NC) of the machine tool 1 and the supporting table 16 is correspondingly moved under control.

In another implementation, as an alternative to moving the opening sections 17*a*, 17*b* shown in FIGS. 2*a, b* after cutting the workpiece part 12 free from the workpiece 2, the positions A1, A2 can also be assumed by moving the opening sections 17*a*, 17*b* before the workpiece part 12 is cut free from the workpiece 2.

Figure 2C:
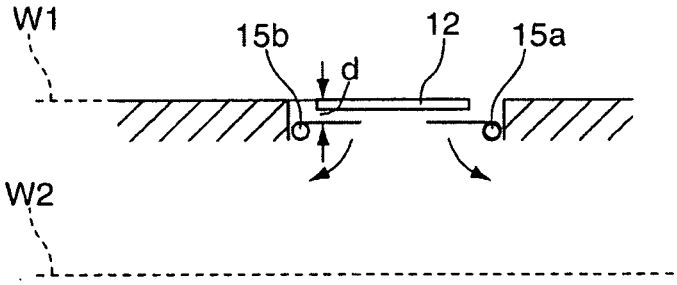
Figure 2D:
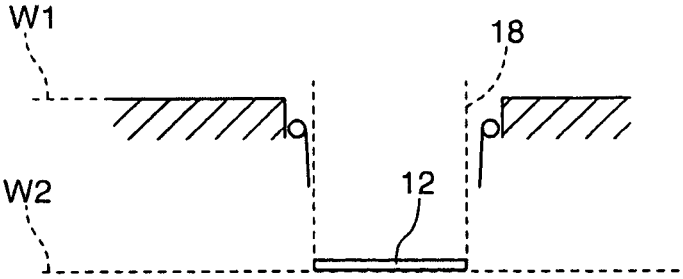

To bring the workpiece part 12 in free fall through the through-opening D1 to the removal position W2, the two supports 13*a*, 13*b* are accelerated linearly downwards in the negative Z direction (to a position shown in FIG. 2*c*) out of their horizontal position in the plane of the sheet (shown in FIG. 2*a*) with an acceleration that corresponds, for example, to three times the acceleration due to gravity acting on the workpiece part 12. Through the linear movement of the supports 13*a*, 13*b* downwards for a distance d of about 3 mm, the workpiece part 12 is lifted off the supports 13*a*, 13*b* as shown in FIG. 2*c*. The two supports 13*a*, 13*b* are then pivoted about their respective pivot axles 15*a*, 15*b* as indicated by the arrows in FIG. 2*c*, and thus brought into an opening position situated outside a path of movement 18 of the workpiece part 12, as shown in FIG. 2*d*. In this way, the workpiece part 12 is able to reach its removal position W2 in free fall and unimpeded by the supports 13*a*, 13*b* after the supports are accelerated linearly in the negative Z direction to the position shown in FIG. 2*c*, from which the workpiece part 12 can subsequently be discharged from the machine tool 1. Thus, the time required to move the supports 13*a*, 13*b* from the position shown in FIG. 2*b* to the position shown in FIG. 2*d* is less than the time during which the workpiece part 12 falls through the distance d such that the workpiece part 12 does not touch the supports 13*a*, 13*b* after the supports 13*a*, 13*b* have been moved. The movement of the supports 13*a*, 13*b* after the position of FIG. 2*b* is a combination of a linear movement (along the negative Z direction) and a pivoting movement about the respective axles 15*a*, 15*b*.

As alternative to the above-described movement of the supports 13*a*, 13*b*, the same result can also be achieved by merely pivoting the supports 13*a*, 13*b*. But in this case, the acceleration that is required to lift the workpiece part 12 from the supports 13*a*, 13*b*, without this sliding along the supports 13*a*, 13*b*, depends on the distance of the workpiece part from the respective pivot axles 15*a*, 15*b*. The smaller is the distance of the workpiece part 12 from the pivot axles 15*a*, 15*b*, the greater must the acceleration during the pivoting be selected to be.

As another alternative to the movement sequence described in connection with FIGS. 2*c-d*, the workpiece part 12, supported initially on the upper surface of the supports 13*a*, 13*b*, can be moved by means of a linear movement by a distance of, for example, a few millimeters, into a position located beneath the plane of the sheet, in order to avoid the workpiece part getting caught on the remainder of the workpiece (not shown). The above-described sequence of movements shown in FIGS. 2*b*-2*d*) can then be effected from this lowered position. As an alternative to pivoting the supports 13*a*, 13*b*, the supports 13*a*, 13*b* can be moved out of the path of movement 18 of the workpiece part 12 in some other way, for example, in a linear movement at right angles to the direction of gravity (along one or more of the X and Y directions), for example, by displacing the supporting table 16 horizontally, whereby the through-opening D1 is likewise widened.

Figure 3A:
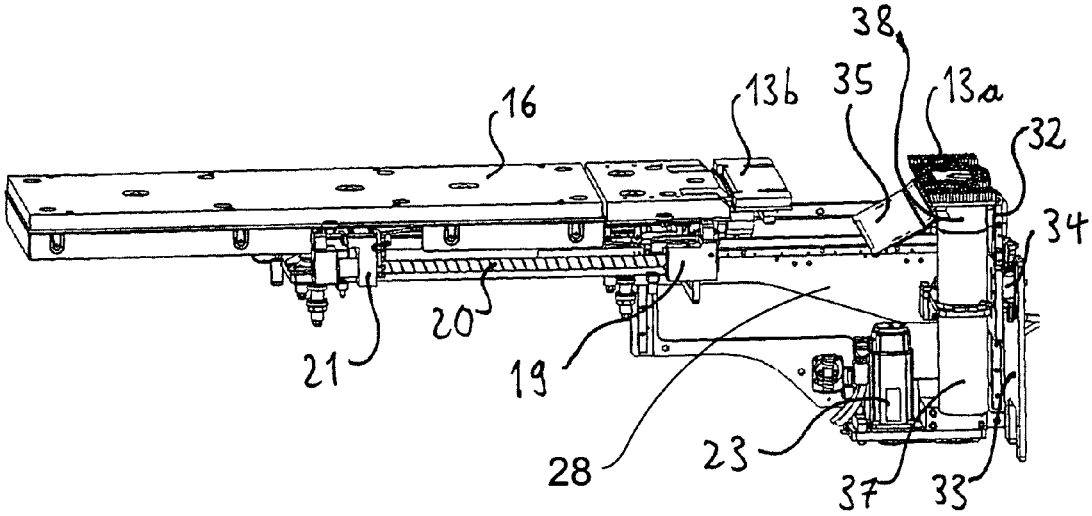
FIGS. 3*a* and 3*b* are perspective partial cutaway views of the machine tool of FIG. 1 with two opening sections and two supports before and after pivoting.

With reference to FIGS. 3*a, b*, which each show a perspective detail view of the bottom part of the machine tool 1 of FIG. 1, there follows an explanation of how the movement sequence described in FIGS. 2*a-d* can be implemented in terms of structural engineering. In order to move the opening sections 17*a*, 17*b* to the position A1 shown in FIG. 2*b*, the supporting table 16 is in connection with a spindle drive shown in FIG. 3*a* as a movement unit, and the spindle drive includes an electric motor 19 and a threaded spindle 20 that extends in the direction of the opening movement (Y direction). The threaded spindle 20 and the electric motor 19 are arranged beneath the plane of the sheet, are offset in the X direction with respect to the supporting table 16, and are adjacent to the supporting table 16. A spindle nut 21 secured to the supporting table 16 is guided on and by the threaded spindle 20 and serves for continuous movement of the supporting table 16 in the horizontal Y direction.

The path of movement of the spindle nut 21 along the Y direction is controlled by way of a control unit 22 (shown in FIG. 1) of the machine tool 1. The control unit 22 is used additionally to control the movement of the workpiece 2 and the punch apparatus 3 and the laser machining head 4 during implementation of a machining program for cutting the workpiece part 12 free from the workpiece 2. The control unit 22 is also used for controlling the displacement of the supporting table 16, by controlling the flow of current through the electric motor 19 as a function of the maximum dimension L1, L2 of the workpiece part 12. The discharge position, for example, A1 or A2 along the horizontal direction Y is continuously controllable by the threaded spindle 20.

Figure 3B:
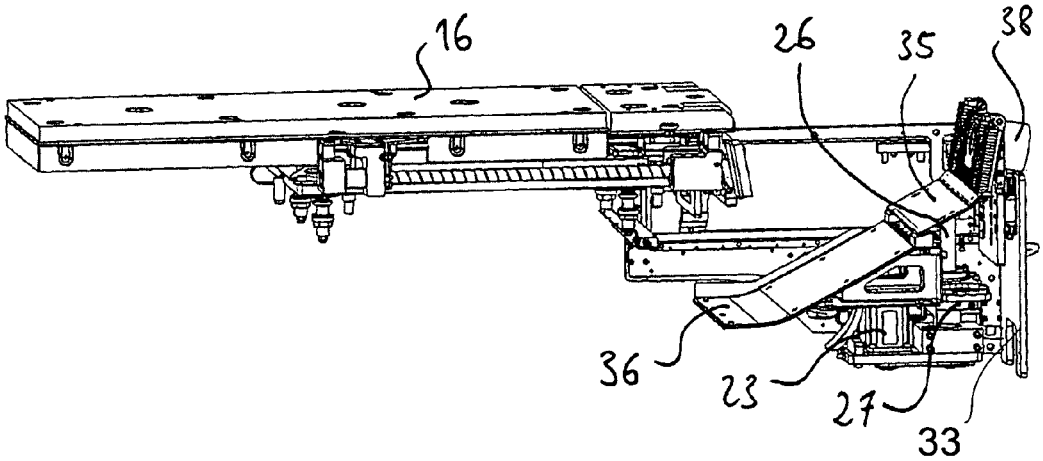

From the horizontal position shown in FIG. 3*a* (which corresponds to the position depicted in FIG. 2*b*), the supports 13*a*, 13*b* are brought into a downwardly pivoted position shown in FIG. 3*b* (which corresponds to the position depicted in FIG. 2*d*), in order to discharge the workpiece part 12 as shown in FIGS. 2*a-d*. For this, a second movement unit shown in FIGS. 4*a* and *b* is provided. The second movement unit includes a second electric motor as drive 23, which is coupled in respect of movement via a toothed belt 24 to a vertically extending threaded spindle 26 guided in an overload-protected bearing 25. The vertical threaded spindle 26 of the second movement unit includes a spindle nut 27, which can be moved in and against the direction of gravity (negative Z direction). The spindle nut 27 is secured to a guide plate 28, which in turn is linearly slidably guided in a plate 29 extending along the Y-Z plane in and against the direction of gravity.

Figure 4A:
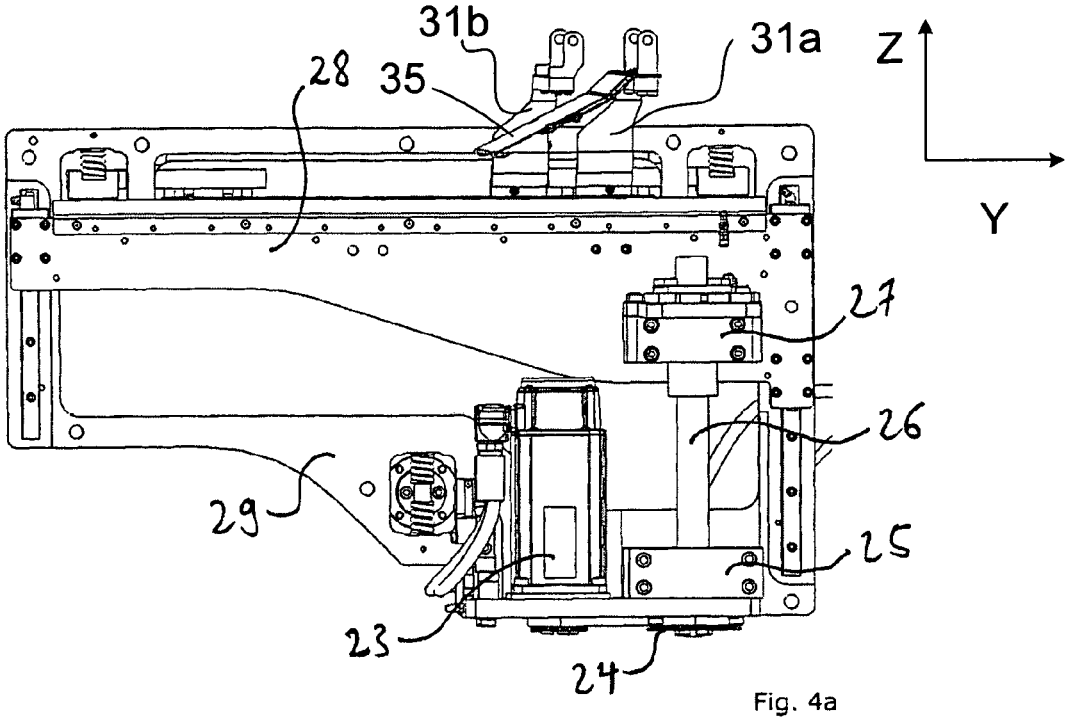
FIGS. 4*a* and 4*b* are side and opposite cross-sectional views of a movement unit and a guide for moving the supports.
Figure 4B:
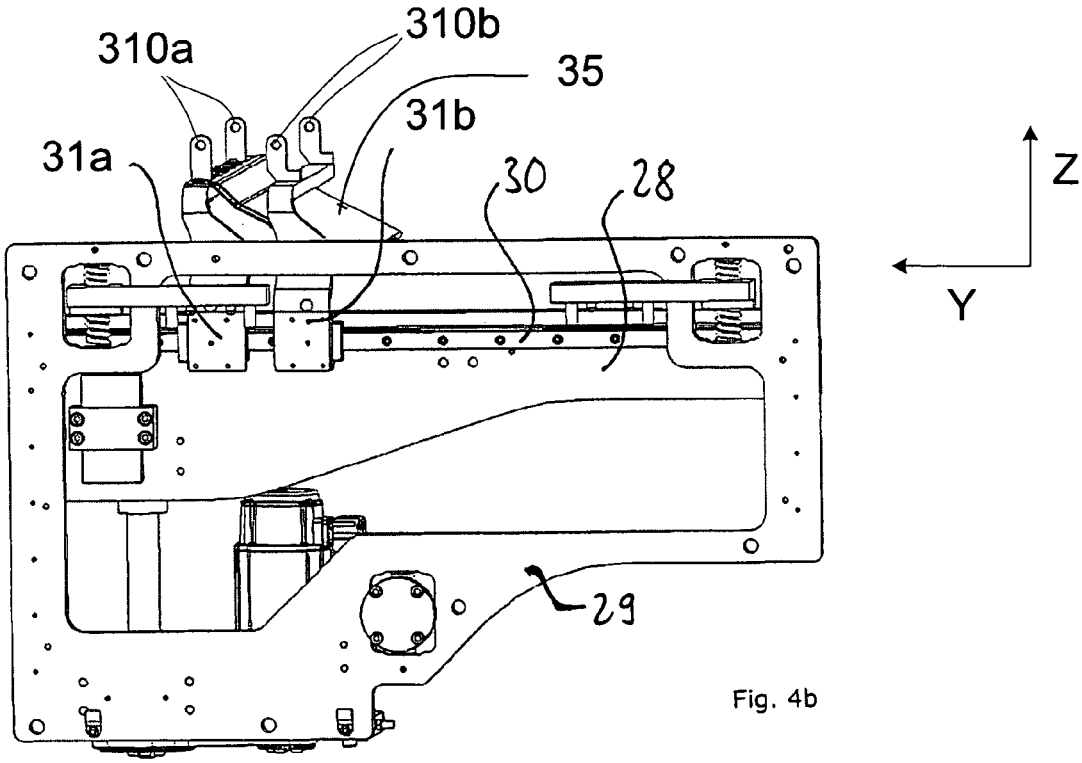

As shown in FIG. 4*b*, the guide plate 28 has a guide rail 30 extending horizontally along the Y direction, in which two connection pieces 31*a*, 31*b* are linearly slidably guided. The connection pieces 31*a*, 31*b* act on the respective supports 13*a*, 13*b* eccentrically with respect to the pivot axles 15*a*, 15*b* and are rotatably mounted thereon, whereas they are guided non-rotatably along the guide rail 30. The connection pieces 31*a*, 31*b* are rotatably coupled to the supports 13*a*, 13*b* by holes 310*b*, 310*a* that receive the respective axles 15*a*, 15*b*. If the spindle nut 27 is moved downwards by means of the drive 23, the guide plate 28 is lowered and the connection pieces 31*a*, 31*b* guided on the guide rail 30 are carried with it. During this movement, the connection pieces 32*a*, 31*b* are displaced horizontally along the guide rail 30 owing to the non-rotatable mounting. During this movement, the supports 13*a*, 13*b* are pivoted downwards out of their horizontal position by the connection pieces 31*a*, 31*b* acting eccentrically with respect to the pivot axles 15*a*, 15*b*. The length of the guide rail 30 is such that, during the movement of the second opening section 17*b* in the horizontal direction (by moving the support 13*b*), the second connection piece 31*b* is able to be carried along into the position along the Y axis shown in FIGS. 3*a, b*.

In addition to the pivoting movement (which is shown in FIG. 2*d*), to implement also the linear movement in the first part of the movement sequence shown in FIG. 2*c*, it is necessary to move the pivot axles 15*a*, 15*b* in or against the direction of gravity. This is achieved by moving the connection pieces 31*a*, 31*b* further upwards than would be necessary for the horizontal alignment of the supports 13*a*, 13*b*. The supports 13*a*, 13*b* are here pressed against a stop (not shown), which prevents the supports 13*a*, 13*b* from pivoting upwards out of the horizontal position. A force is exerted on the supports 13*a*, 13*b* and hence also on the bearings of the pivot axles 15*a*, 15*b*.

As shown in FIG. 3*a*, the pivot axle 15*a* is rotatably mounted on a support plate 32 that is vertical, i.e., running in the direction of gravity such that the axle 15*a* can rotate as shown in FIG. 2*d*. The support plate 32 is coupled to the connection pieces 31*a*, 31*b* via the supports 13*a*, 13*b*. The support plate 32 is guided on a further plate 33, likewise running in the direction of gravity, of a cross-frame (not shown) and by applying a force (along the Z direction) against the direction of gravity, can be biased by means of a stop unit 34, which includes a spring unit (not shown) as a shock-absorber and also a hydraulic piston (not shown). The force applied by the connection pieces 31*a*, 31*b* against the direction of gravity presses the support plate 32 (which is coupled to the connection pieces 31*a*, 31*b* via the supports 13*a*, 13*b*) and hence the bearing of the pivot axle 15*a* upwards, against the spring and hydraulic force of the stop unit 34 acting in the direction of gravity, typically by a stroke of about 3-5 mm. The mounting of the second support 13*b* on the supporting table 16 is of corresponding construction.

If the connection pieces 31*a*, 31*b* in the position shown in FIG. 4*a, b* are moved downwards by the drive 23, the pivot axles 15*a*, 15*b* also move synchronously downwards on account of the mechanical bias of the spring and hydraulic forces of the stop unit 34 acting in the direction of gravity, so that the supports 13*a*, 13*b* move for the extent of the bias in a linear movement parallel to the plane of the sheet, that is, perpendicular to the X-Y plane. As soon as the connection pieces 31*a*, 31*b* are moved further downwards, the above-described pivoting of the supports 13*a*, 13*b* immediately follows the linear movement. The speed of pivoting is here matched to the preceding linear movement in such a way that after being lifted or separated from the supports 13*a*, 13*b*, the workpiece part 12 does not come into contact with the supports 13*a*, 13*b*. FIG. 3*b* shows the supports 13*a*, 13*b* after completion of the above movement in an open position, in which they have been fully pivoted and are at an angle of about 80° to 90° relative to the plane of the sheet (the X-Y plane).

In order to remove a workpiece part 12 after its free-falling movement, shown in FIGS. 2*c-d*, from the working region of the machine tool 1, a chute 35 is mounted on the first connection piece 31*a*. The chute 35 is carried downwards by the parallel displacement of the connection piece 31*a* and in the open position of the supports 13*a*, 13*b* projects into the path of movement (not shown) of the workpiece part 12. In the open position of the supports 13*a*, 13*b*, a fixed chute 36 immediately adjoins the chute 35 mounted on the connection piece 31*a*. At its removal position, the free-falling workpiece part 12 thus meets either the fixed chute 36 or the chute 35 secured to the first connection piece 31*a* and referred to hereafter as the movable chute, and can be removed from the working region of the machine tool 1 in a sliding movement.

The movable chute 35 provided in addition to the fixed chute 36 is needed to cover a suction pipe 37 shown in FIG. 3*a*. The suction pipe 37, in the horizontal position of the first support 13*a* shown in FIG. 3*a*, is connected to the suction opening 10 of the first support 13*a*. The suction pipe 37 is secured to the spindle nut 27 shown in FIG. 3*b* and on displacement of the spindle nut 27 is carried downwards with it in the direction of gravity. An end piece 38 of the suction pipe 37 is mounted on the first support 13*a* and is pivoted with this, as shown in FIG. 3*b*. A beam stop (not shown) is provided in the suction pipe 37 at the lower end thereof, in order to intercept the laser beam that passes through the suction opening 10 during laser operation.

Figure 5:
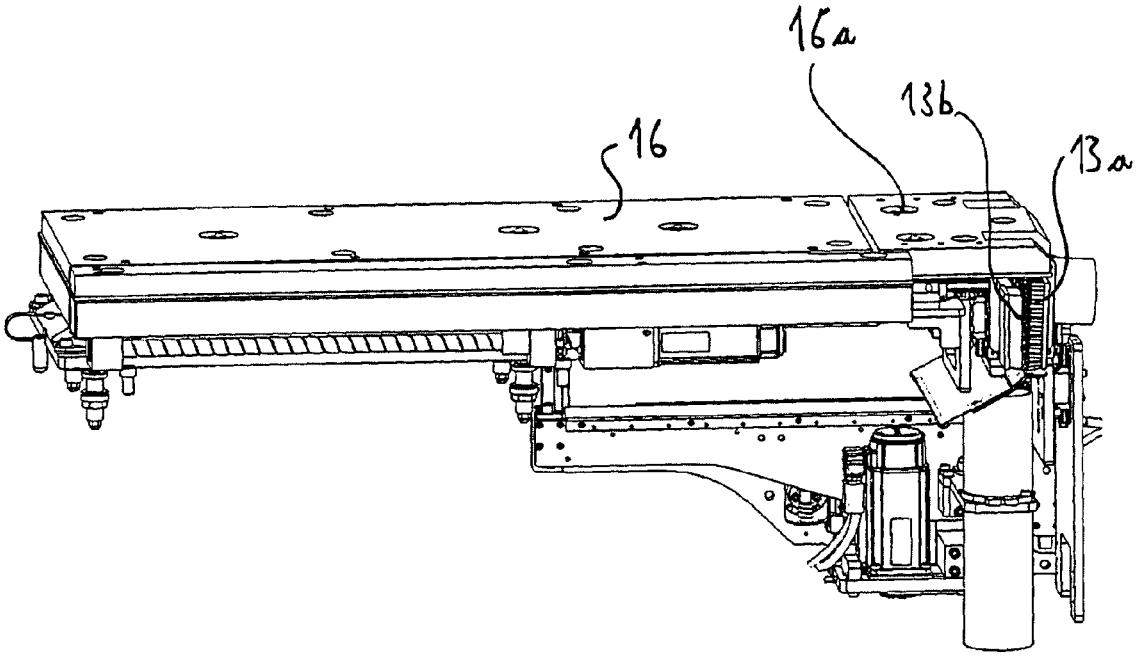
FIG. 5 is a perspective partial view of the machine tool of FIG. 1 with the two opening sections in a closed position.

In the case of the machine tool 1 shown in FIG. 1, machining of the workpiece 2 with the laser machining head 4 at the machining position 11 can be followed by machining of the workpiece 2 at the adjacent machining position 9 of the punch apparatus 3. For that purpose, the opening sections 17*a*, 17*b* can be moved out of the position shown in FIG. 3*b* into a closed position, which is shown in FIG. 5. In the closed position, the opening sections 17*a*, 17*b* completely close an opening in the workpiece support 5 and the supports 13*a*, 13*b* lie in their downwardly pivoted position with their upper surfaces adjacent. The supports 13*a*, 13*b* are thus protected against debris (for example, chips etc.) produced during machining of the workpiece 2 at the machining position 9 of the punch apparatus 3. A subregion 16*a* of the supporting table 16, the width of which subregion corresponds approximately to the width 2*b* of the supports 13*a*, 13*b*, completely covers the region that in FIG. 1 was occupied by the supports 13*a*, 13*b*.

The above-described movement sequence can be used not only to discharge workpiece parts from the machining region 11 of the laser machining head 4, but also to discharge workpiece parts from the machining region 9 of the punch apparatus 3.

It shall be understood that a discharge can advantageously be carried out in the above-described manner also on other machine tools, for example, on the punch apparatus and on bending machines, in which, after being cut free, the workpiece parts are subjected to further machining by bending before they are discharged from the machine tool. The discharge can also be accelerated in this case by the variable positions of the opening sections as a function of the individual dimensions of the particular workpiece part to be discharged, and thus idle times during machining can be reduced.

Figure 6A:
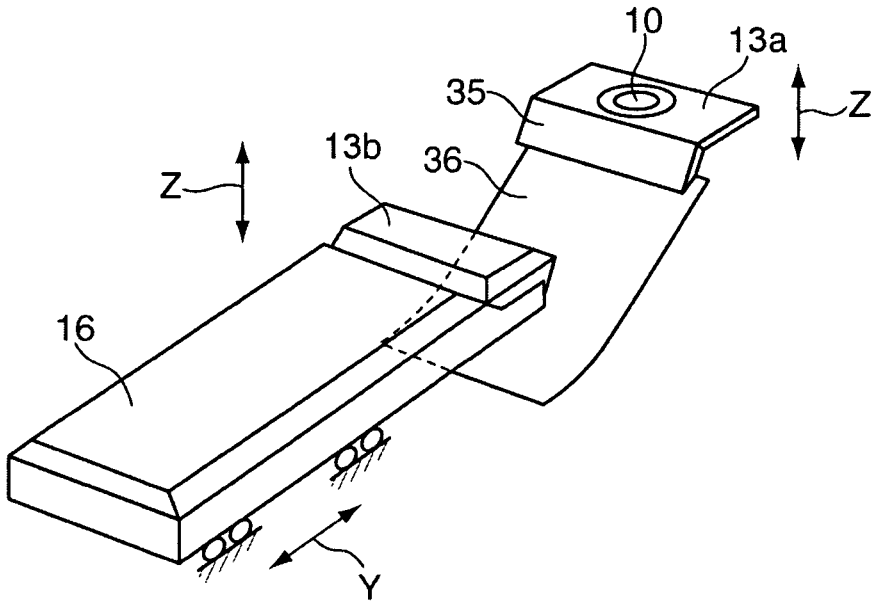
FIG. 6*a* is a perspective view of an implementation of a supporting table of the machine tool of FIG. 1.
Figure 6B:
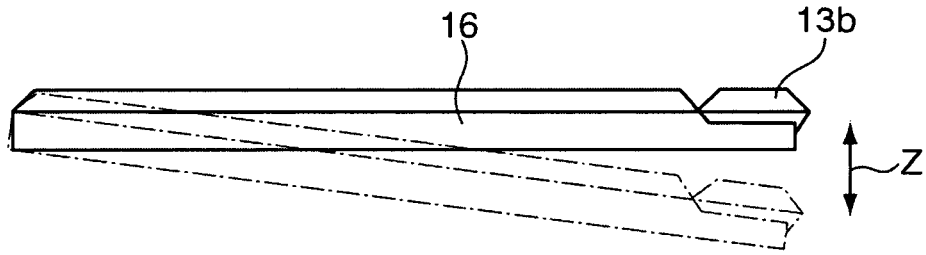
FIGS. 6*b* and 6*c* are side views of an implementation of a supporting table of the machine tool of FIG. 1.
Figure 6C:
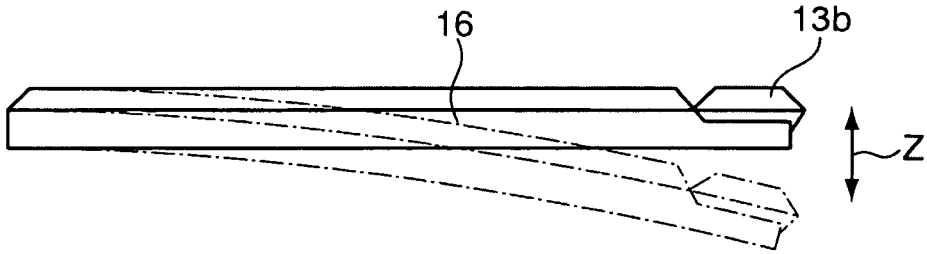

In other implementations, the opening sections may have supports 13*a*, 13*b* that are not pivotable, and the supporting table 16 can be linearly lowered, as shown in FIG. 6*a*. The linear movement of the supporting table 16 can here be effected by a parallel displacement of the supporting table 16 in the direction of gravity (Z direction) or the supporting table 16 can be rotatably mounted at the end remote from the through-opening (see FIG. 6*b*), so that in the case of a supporting table 16 that has an adequate length in the horizontal Y direction (for example, more than 1000 mm, or more than 1500 mm), at the end nearest the through-opening a virtually linear movement in the direction of gravity is achieved over the comparatively small distance to be covered in the vertical Z direction. As shown in FIG. 6*c*, the supporting table 16 can also be non-rotatably mounted at the end remote from the through-opening and consist of a flexible material. If, to generate the lowering movement, the supporting table 16 is in that case supported only at its end remote from the through-opening, with a suitable choice of the resilient properties of the material and the length and the width of the supporting table, a virtually linear lowering movement at the end nearest the through-opening is achieved. The mounting of the support table at the end nearest the through-opening can be effected by an axle-controllable in the vertical direction.

In other implementations, the machine tool can include a measuring device that determines a distance traveled by the opening sections 17*a*, 17*b* in the horizontal Y direction. The measuring device can be a position sensor or any other suitable position measuring device.

Figure 7A:
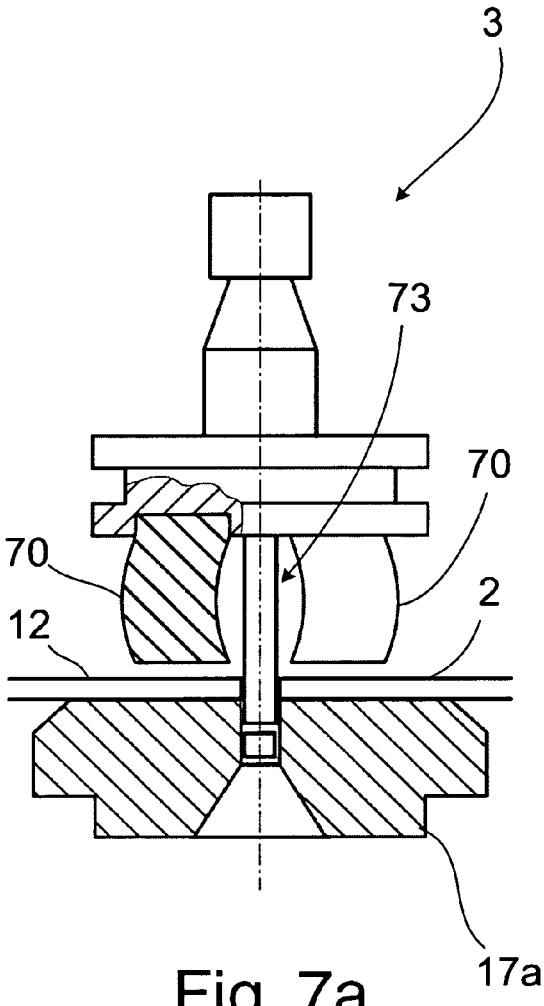
FIGS. 7*a* and 7*b* are side and partial cutaway views of an implementation of a punch apparatus of the machine tool of FIG. 1.
Figure 7B:
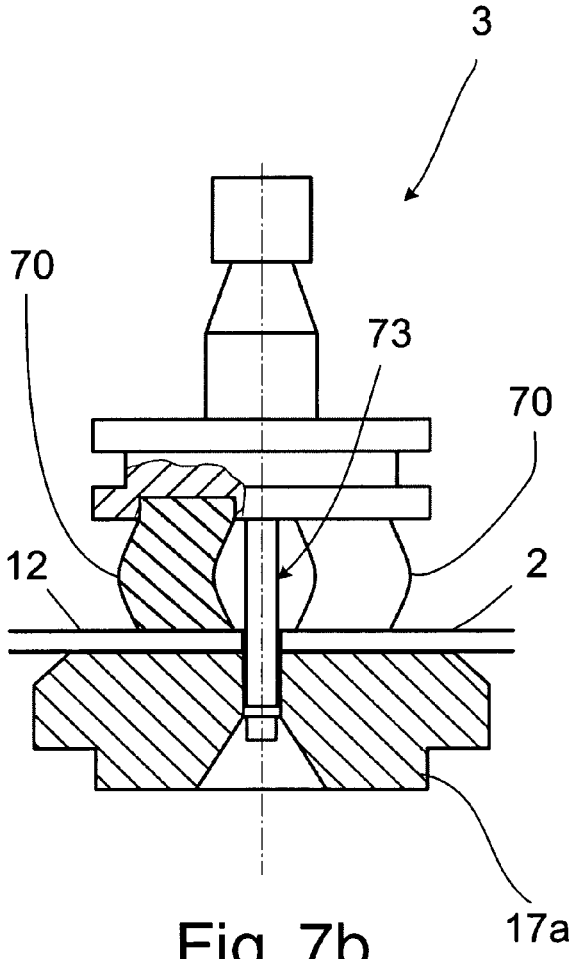

Referring also to FIGS. 7*a* and 7*b*, the punch apparatus 3 can additionally serve as a fixing unit for a workpiece part 12 during movement of the second opening section 17*b*. During the opening movement of the second opening section 17*b*, a punch 73 of the punch apparatus 3 remains engaged in a die block (the opening section 17*a*) and to the workpiece 2 mounted at the machining region 9 on the workpiece support 5, and at the same time presses the workpiece part 12 to be discharged, for example, by means of a resilient element 70 that can be made of, for example, Eladur™, towards the workpiece support 5. The two parts of the resilient element 70 are arranged to the left and to the right of the portion of the punch 73, which is inserted into the opening section 17*a*. The resilient element 70 can be made of an appropriate kind of elastically deformable material, in particular, of a synthetic material such as Eladur™. During the relative movement between the opening sections 17*a*, 17*b*, the resilient element 70 (and not the portion of the punch 73 that is inserted into the opening section 17*a*) presses the workpiece 2 and the workpiece part 12 against the opening section 17*a*, as shown in FIG. 7*b*, to prevent movement of the workpiece part 12 relative to the workpiece 2. In this way, the punch apparatus 3 (and in particular, the punch 73) and the resilient element 70 act as a fixing device to fix the workpiece part 12 in position at the fixed-position opening section 17*a* during relative movement of the opening sections 17*a*, 17*b* in the horizontal Y direction.

What is claimed is:

1. A machine tool for separative machining of workpieces, the machine tool comprising:

a workpiece support; and a discharge device provided on the workpiece support for discharging a workpiece part produced as a product of the separative machining, wherein the discharge device comprises two opening sections that are adjustable relative to one another in a horizontal Y direction that lies in an X-Y plane to form a through-opening for discharge of the workpiece part along a vertical direction Z that is perpendicular to the X-Y plane, the two opening sections adjustable relative to one another in the horizontal Y direction to adjust a width of the through-opening for discharge of the workpiece part, wherein the two opening sections comprise respective supports that are mounted to pivot downwardly about respective pivot axles from a horizontal position parallel to the X-Y plane, wherein the respective supports are lowerable, under acceleration, in the vertical direction Z, and wherein at least one of the respective supports is rotatably mounted to a supporting table that is displaceable in the horizontal Y direction.

2. The machine tool of claim 1, further comprising a control unit for controlling a position of the opening sections produced during the separative machining of the workpiece as a function of a maximum dimension in the horizontal Y direction of the workpiece part.

3. The machine tool of claim 1, further comprising a movement unit that is configured to continuously move at least one of the opening sections in the horizontal Y direction.

4. The machine tool of claim 3, wherein the movement unit comprises a spindle drive.

5. The machine tool of claim 1, further comprising a measuring device that determines a distance traveled by the opening sections in the horizontal Y direction.

6. The machine tool of claim 1, wherein the respective pivot axles extend at a right angle to the horizontal Y direction.

7. The machine tool of claim 1, wherein the respective supports are lowerable with a linear movement a distance of less than or equal to about 10 mm.

8. The machine tool of claim 1, wherein at least one of the opening sections comprises a supporting table that is displaceable in the horizontal Y direction.

9. The machine tool of claim 8, wherein at least one end of the supporting table nearest the through-opening is lowerable under acceleration in a direction of gravity.

10. The machine tool of claim 1, wherein the opening sections are movable relative to one another in the horizontal Y direction into a closed position in which the opening sections close an opening in the workpiece support.

11. The machine tool of claim 10, wherein the respective supports in a downwardly pivoted state have upper surfaces that lie at least partially adjacent to one another when the opening sections are in the closed position.

12. The machine tool of claim 1, wherein one of the two opening sections is in a fixed position in the horizontal Y direction.

13. The machine tool of claim 12, further comprising a fixing device that fixes the workpiece part at the fixed position during relative movement of the opening sections in the horizontal Y direction.

14. The machine tool of claim 1, further comprising a rigid chute arranged in the through-opening beneath the opening sections and configured to discharge the workpiece part.

15. A method of discharging a workpiece part produced on a machine tool as a product of separative machining, using a discharge device that comprises two opening sections that are adjusted relative to one another in a horizontal Y direction to form a through-opening for discharge of the workpiece part, the method comprising:

moving the two opening sections, while respective supports of the two opening sections are disposed in a support position, relative to one another in the horizontal Y direction to adjust a width of the through-opening for discharge of the workpiece part, the respective supports being in-plane with each other and parallel to a workpiece support;

moving the respective supports of the two opening sections out of the support position by accelerating the respective supports downwardly in a vertical Z direction that is perpendicular to the horizontal Y direction; and widening the through-opening by pivoting the respective supports of the two opening sections downwardly about respective pivot axles that lie in an X-Y plane that includes the horizontal Y direction and that is perpendicular to the vertical Z direction, wherein at least one of the respective supports is rotatably mounted to a supporting table that is displaceable in the horizontal Y direction.

16. The method of claim 15, further comprising controlling a position of the opening sections as a function of a maximum dimension in the horizontal Y direction of the workpiece part.

17. The method of claim 15, wherein moving the opening sections includes continuously displacing at least one of the opening sections with continuous displacement control in the horizontal Y direction.

* * * * *